US010976033B1

(12) United States Patent
Lee

(10) Patent No.: US 10,976,033 B1
(45) Date of Patent: Apr. 13, 2021

(54) LIGHTING DEVICE ATTACHED TO HAT VISOR

(71) Applicant: Wen-Sung Lee, Taichung (TW)

(72) Inventor: Wen-Sung Lee, Taichung (TW)

( * ) Notice: Subject to any disclaimer, the term of this patent is extended or adjusted under 35 U.S.C. 154(b) by 0 days.

(21) Appl. No.: 17/000,353

(22) Filed: Aug. 23, 2020

(51) Int. Cl.
*F21V 21/088* (2006.01)
*F21V 23/06* (2006.01)
*F21V 23/04* (2006.01)

(52) U.S. Cl.
CPC ..... *F21V 21/0885* (2013.01); *F21V 23/04* (2013.01); *F21V 23/06* (2013.01)

(58) Field of Classification Search
CPC ..... F21V 21/0885; F21V 23/04; F21V 23/06; A42B 1/242; A42B 1/244
See application file for complete search history.

(56) References Cited

U.S. PATENT DOCUMENTS 6,634,031 B1 * 10/2003 Schlapkohl ..... A42B 1/242 2/209.13
2010/0289433 A1 * 11/2010 Lau ..... H05B 45/00 315/313
2011/0063826 A1 * 3/2011 Lau ..... F21L 4/027 362/190
2015/0198313 A1 * 7/2015 Rementer ..... F21V 23/001 362/105
2017/0089555 A1 * 3/2017 Honeycutt, III ..... F21L 4/027
2019/0178477 A1 * 6/2019 Ross ..... F21V 23/0435

* cited by examiner

*Primary Examiner* — Thomas M Sember

(57) ABSTRACT

A lighting device includes a lighting unit with two arms formed on two ends thereof. The arms each include at least one reception portion. Multiple attachments each have a slide and a clip. The slide of each attachment is slidably engaged with the at least one reception portion of each arm. The clip is pivotably connected to the slide. Each clip includes a slot so as to clip a hat visor. The clip is adjustable by sliding the slide relative to the at least one reception portion. Also, the clip is pivotable relative to the slide to adjust a direction of the slot. The lighting device is able to clip to a hat visor of different shapes by sliding the slide relative to the at least one reception, and by pivoting the clip relative to the slide.

7 Claims, 15 Drawing Sheets

LIGHTING DEVICE ATTACHED TO HAT VISOR

BACKGROUND OF THE INVENTION

1. Fields of the Invention

The present invention relates to a lighting device attached to a hat visor, and more particularly.

2. Descriptions of Related Art

The conventional lighting devices designed to be attached to a hat visor generally includes a lighting unit for generating lighting feature so as to illuminate the road ahead the users. The lighting devices are attached to the visor of a hat. However, the visors of different hats have different curvature, widths and sizes, and the conventional lighting devices may not able to be perfectly attached to the visors. In other words, the lighting devices may not be well secured to the visor so that the lighting devices may drop from the visors.

The present invention intends to provide a lighting device that has adjustable attachments so as to be attached to visors of different shapes and widths.

SUMMARY OF THE INVENTION

The present invention relates to a lighting device and comprises a lighting unit including a lighting portion, and two arms are respectively formed on two ends of the lighting portion. Each arm includes at least one reception portion. Two attachments are respectively connected to the two arms. Each attachment includes a slide and a clip. The slide of each attachment is slidably engaged with the at least one reception portion of each arm, and the clip pivotably connected to the slide. Each clip includes a slot which includes an opening formed in each of two ends of the slot. The slot of each clip allows the attachment to clip a visor of a hat. The clip is adjustable by sliding the slide relative to the at least one reception portion, and the clip is pivotable to adjust a direction of the slot.

The advantages of the present invention are that the lighting device is able to be attached to the visors of different shapes and sizes. Specifically, the slide is slidable relative to the at least one reception portion of each arm so as to adjust the distance between the two clips. The direction of the slot of each clip can be adjusted by pivotable adjustment relative to the slide so as to clip the visors of different curvatures.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
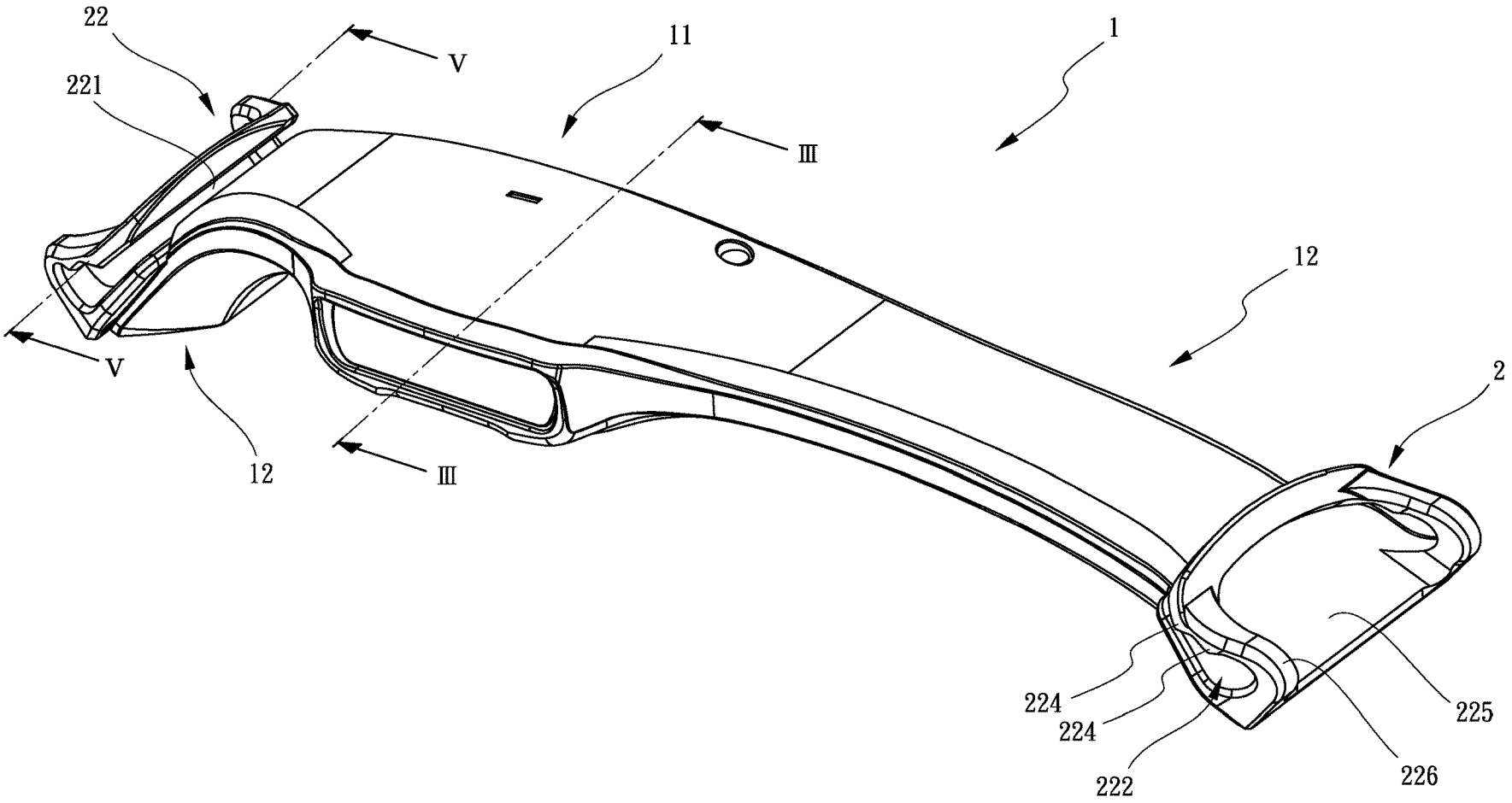
FIG. 1 is a perspective view to show the lighting device of the present invention.

Referring to FIGS. 1 to 7A, the lighting device of the present invention comprises a lighting unit 1 which is removably attached to a visor 101 of a hat 10. Preferably, the lighting unit 1 attached to a position where the visor 101 is connected to the crown of the hat 10. The lighting unit 1 includes a lighting portion 11, and two arms 12 are respectively formed on two ends of the lighting portion 11. Each arm 12 includes a reception portion 13. Two attachments 2 each have a slide 21 and a clip 22. The slide 21 of each attachment 2 is slidably engaged with the reception portion 13 of each arm 12, and the clip 22 is pivotably connected to the slide 21. Each clip 22 is a C-shaped part and includes a slot 221 defined through one side thereof. The slot 221 includes an opening 222 formed in each of two ends thereof. The slot 221 of each clip 22 clips the visor 101 of a hat 10. The clip 22 is adjustable by sliding the slide 21 relative to the reception portion 13, and the clip 22 is pivotable to adjust the direction of the slot 221.

Figure 2:
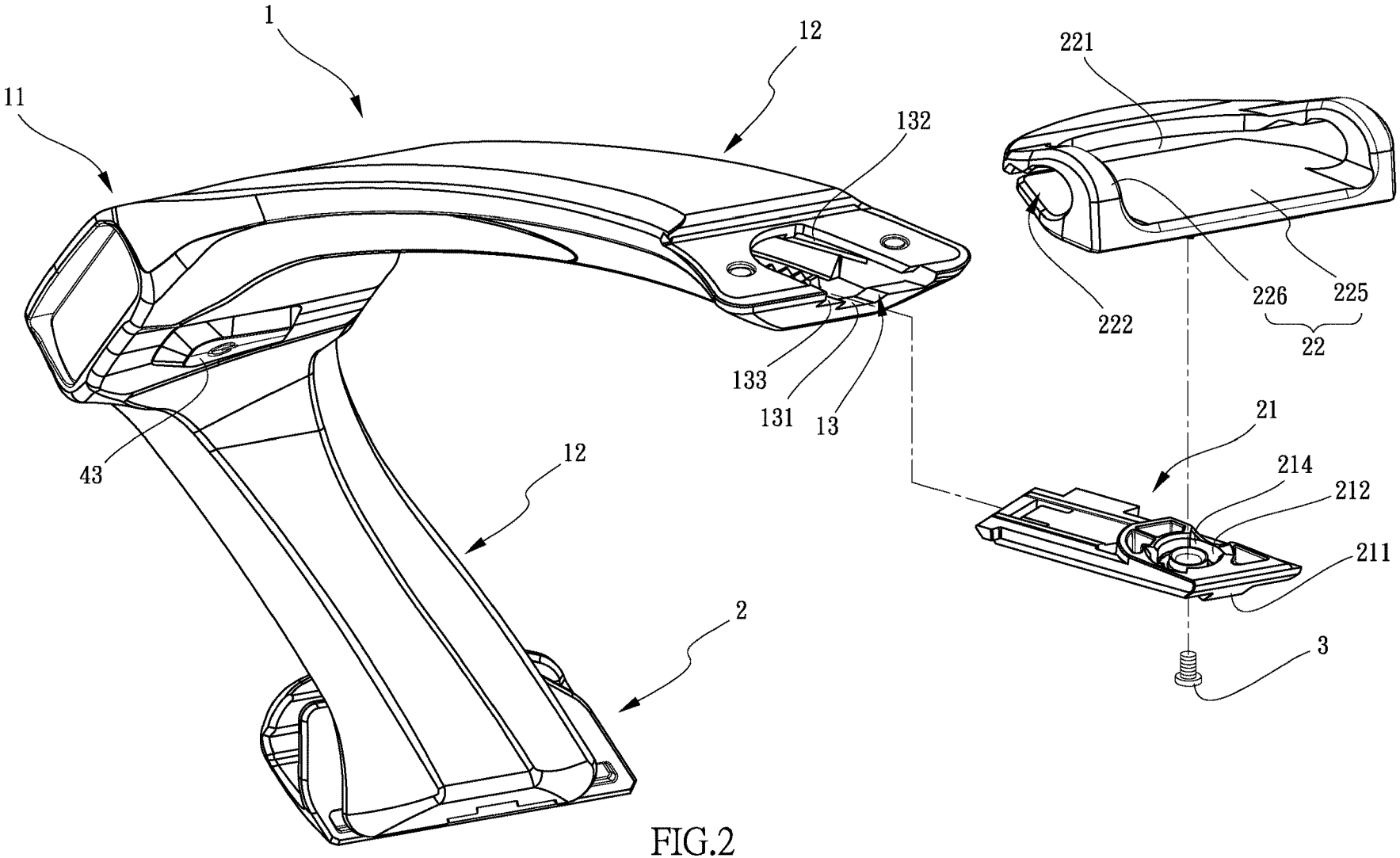
FIG. 2 is an exploded view of the lighting device of the present invention.
Figure 2A:
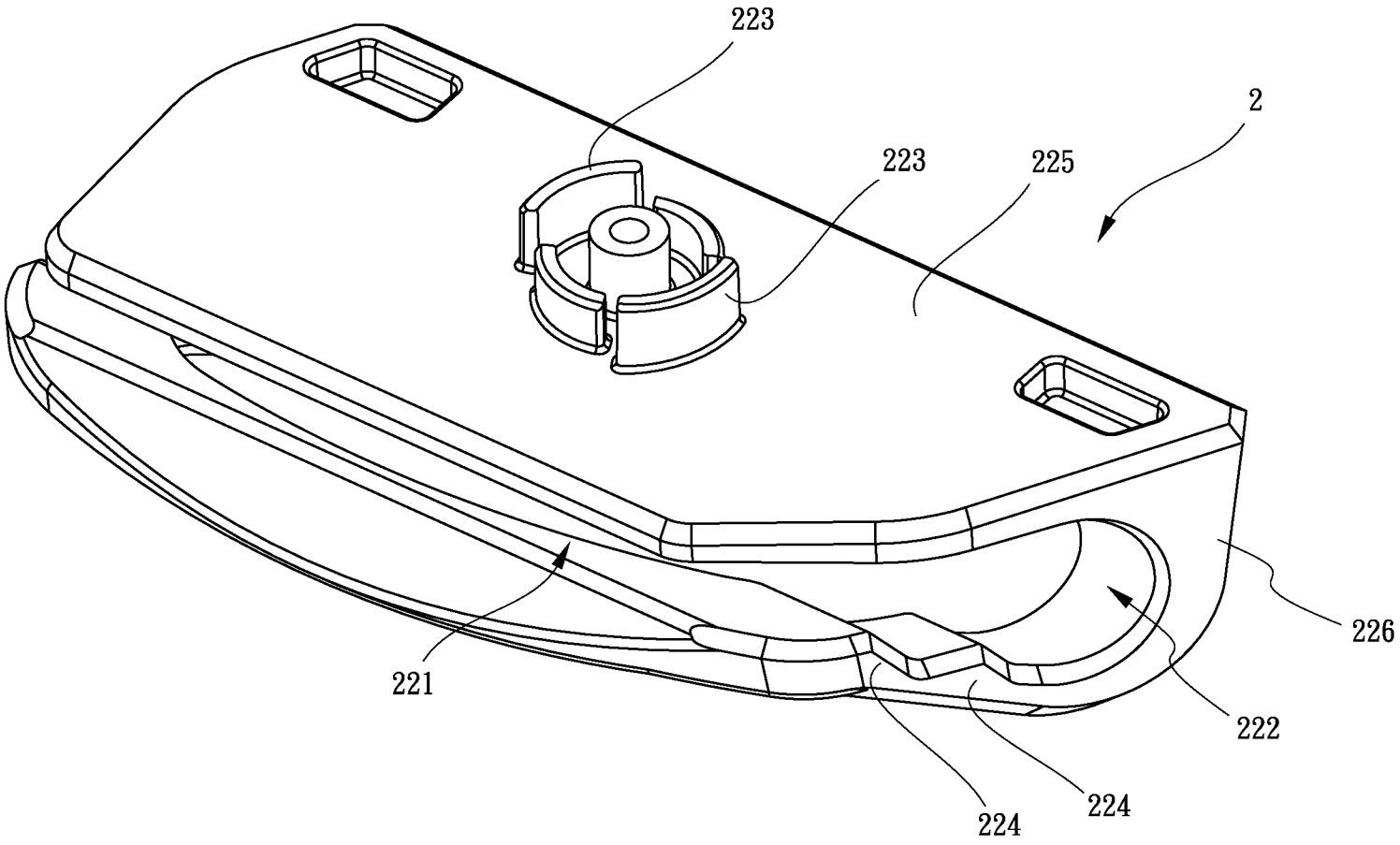
FIG. 2A is a perspective view to show the clip of the lighting device of the present invention.

Each reception portion 13 includes a groove 131. Each slide 21 includes a rail 211 protruding therefrom so that the rail 211 is slidably engaged with the groove 131 corresponding thereto. As shown in FIG. 2, each reception portion 13 includes a first opening 132 and a second opening 133, wherein the first and second openings 132, 133 communicate with the reception portion 13. The first opening 132 is located at the top face and/or a bottom face of the reception portion 13 corresponding thereto. The second opening 133 is located at the distal end of the arm 12 corresponding thereto and located corresponding to the first opening 132. That is to say, the reception portion 13 and the groove 131 form a T-shaped room when viewed from the distal end of the reception portion 13. The slide 21 is able to slide along the groove 131 and moves toward or away from the lighting portion 11.

Figure 7:
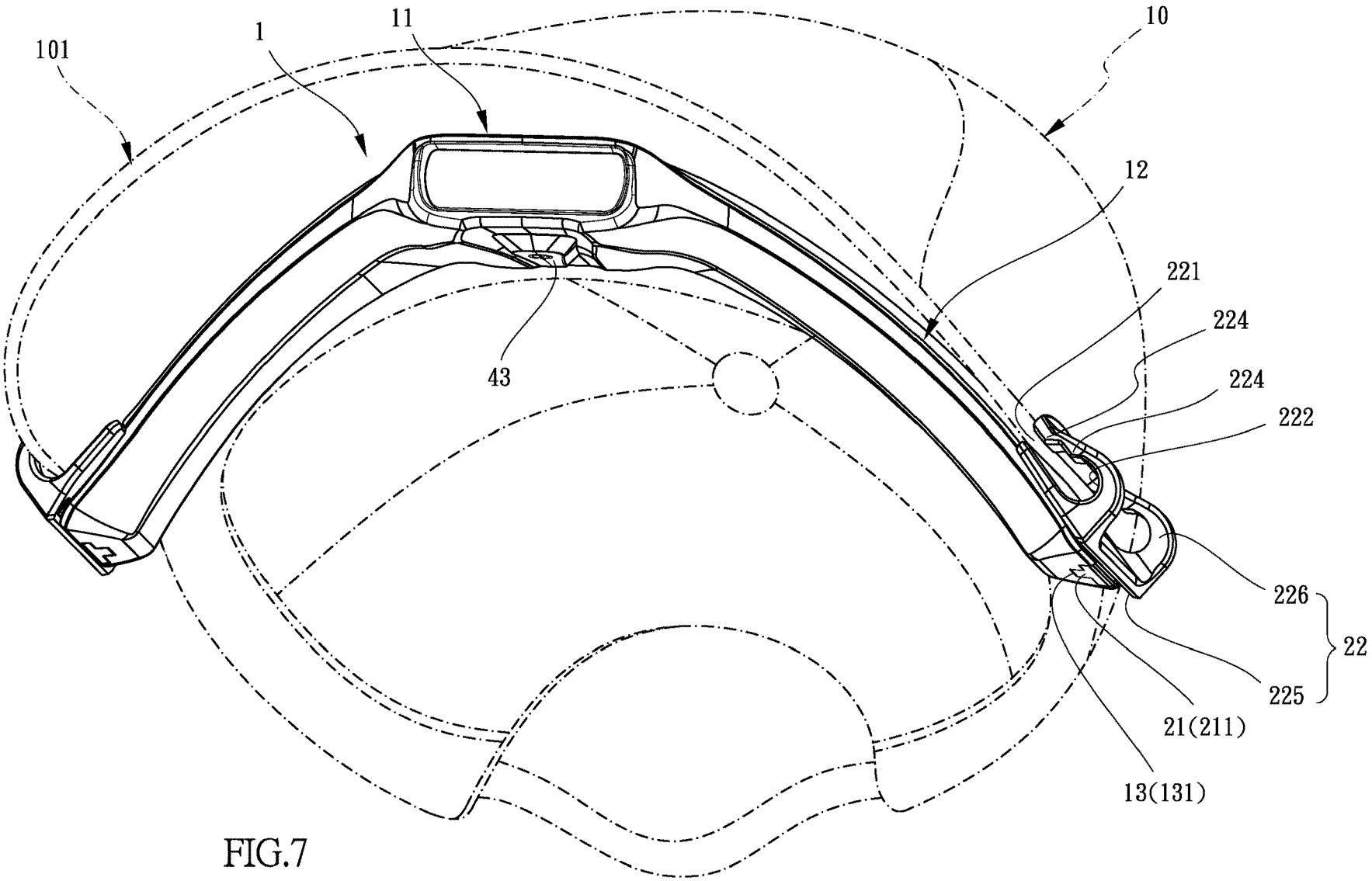
FIG. 7 shows that the lighting device of the present invention is attached to a hat visor.
Figure 9:
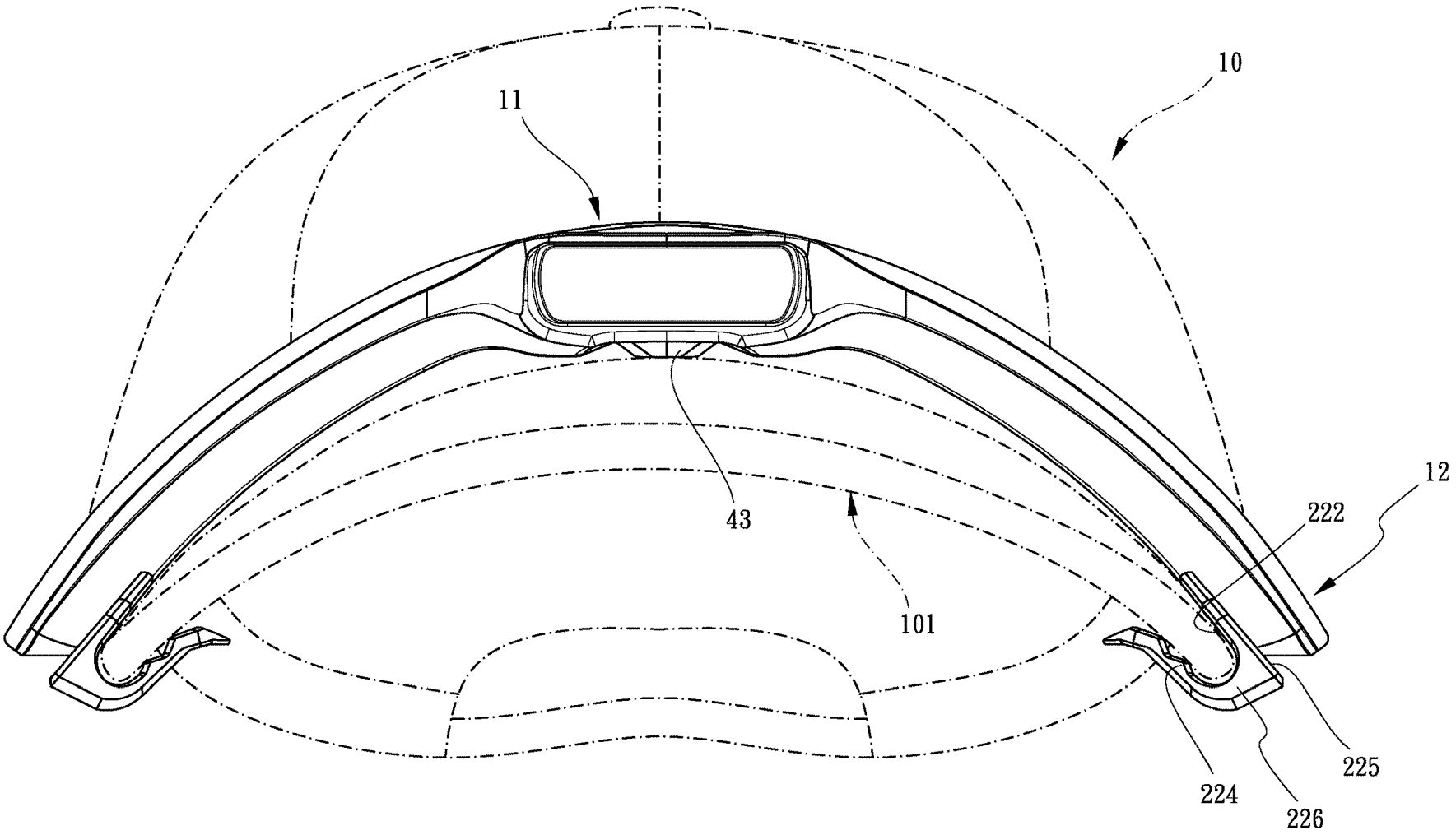
FIG. 9 shows that the lighting device of the present invention is positioned on the top of the visor.

As shown in FIGS. 7 and 9, the lighting unit 1 can be positioned on the top of the visor 101 as shown in FIG. 7, or at the underside of the visor 101 as shown in FIG. 9. That is to say, the first opening 132 can be located at the top of the bottom of the arm 12. Alternatively, the first opening 132 can be formed in the top and the bottom of the arm 12.

Figure 2B:
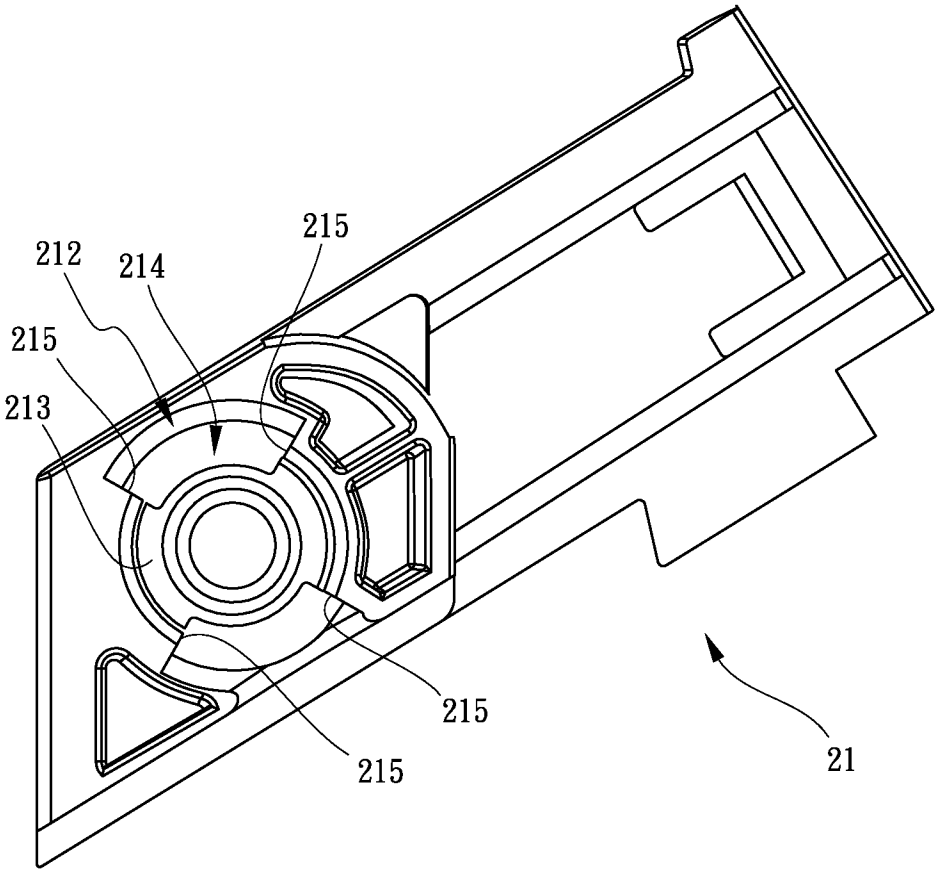
FIG. 2B is a perspective view to show the slide of the lighting device of the present invention.
Figure 3:
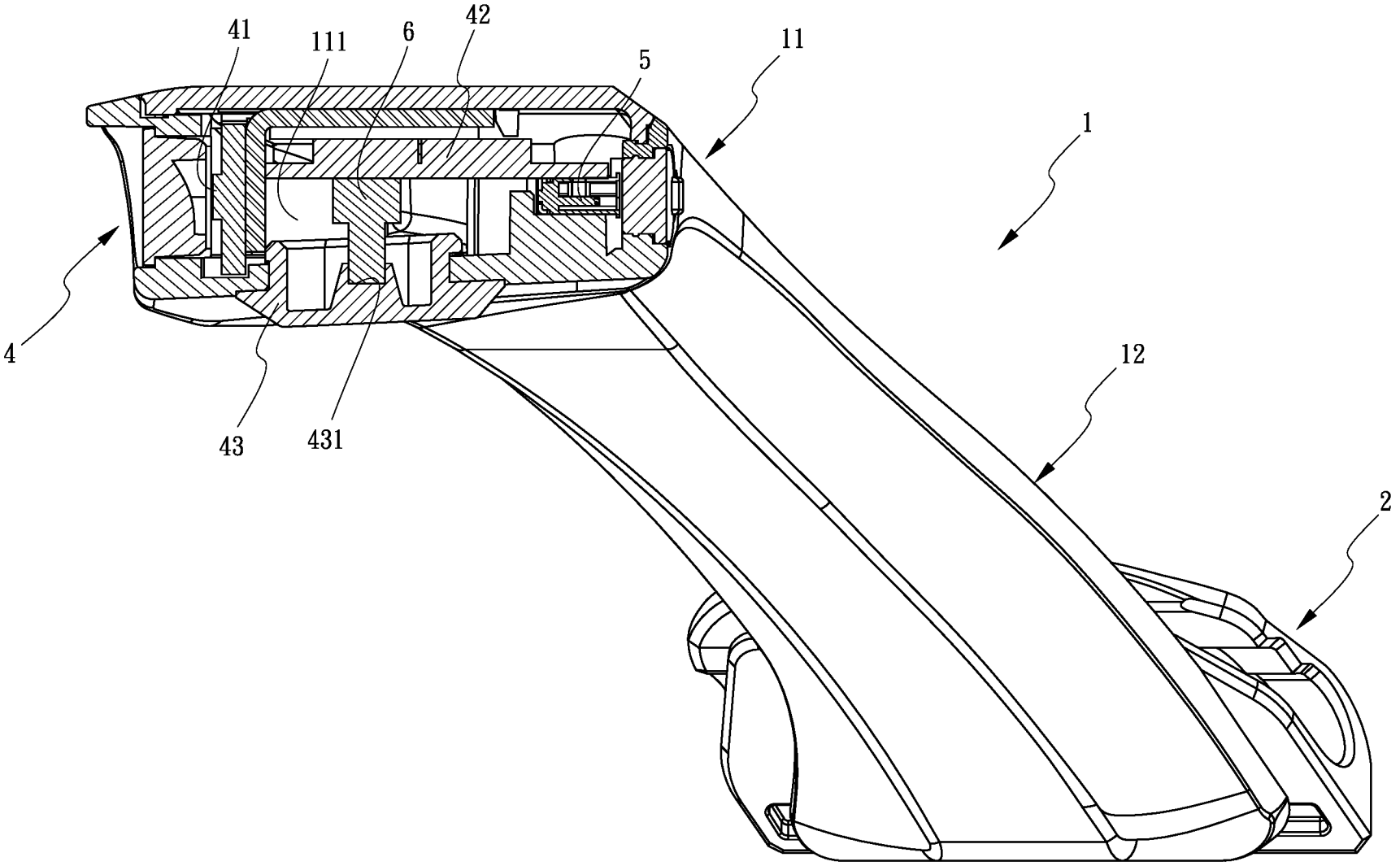
FIG. 3 is a cross sectional view, taken along line III-III in FIG. 1.
Figure 3A:
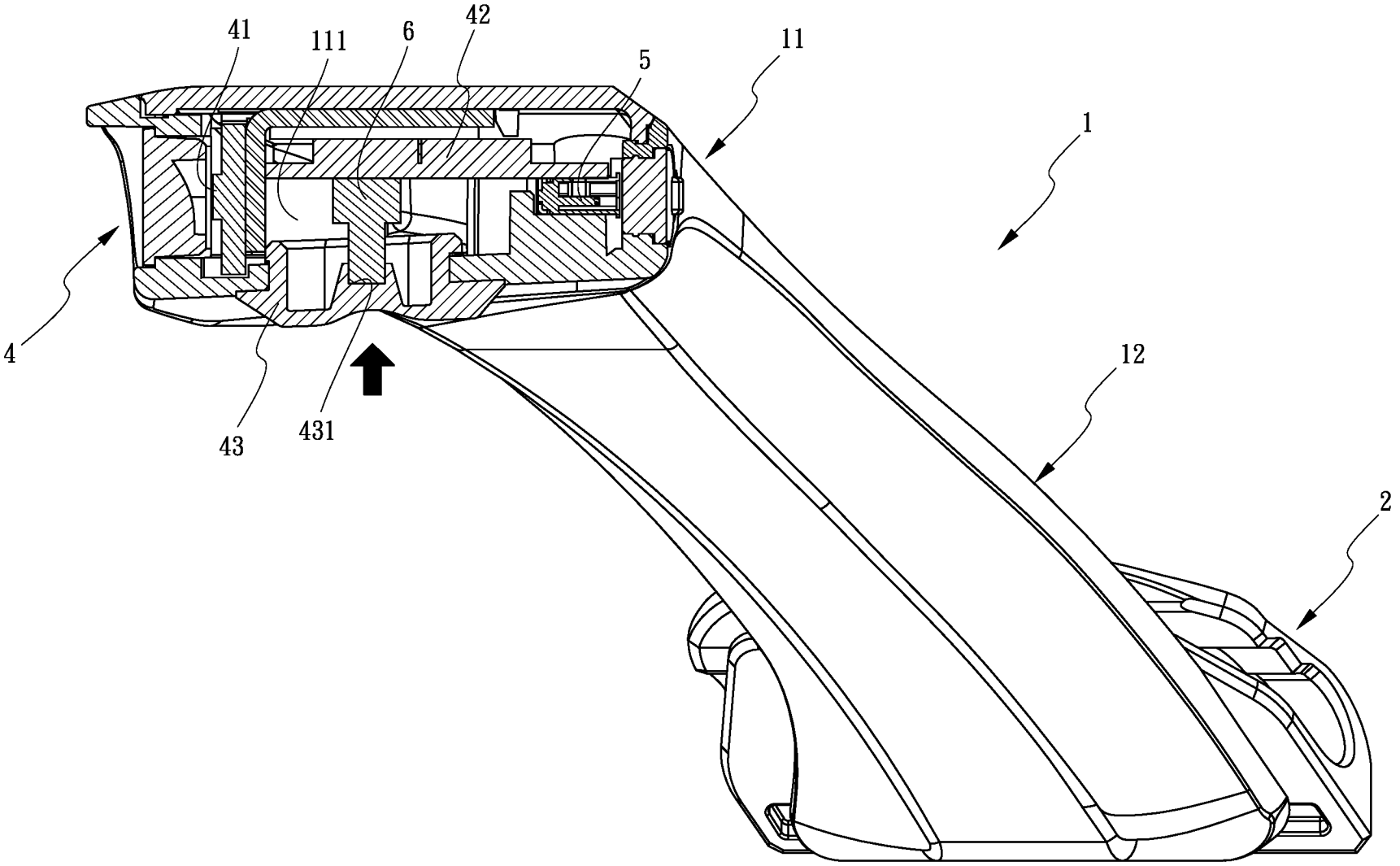
FIG. 3A shows that the button is pushed to activate the lighting unit.
Figure 4:
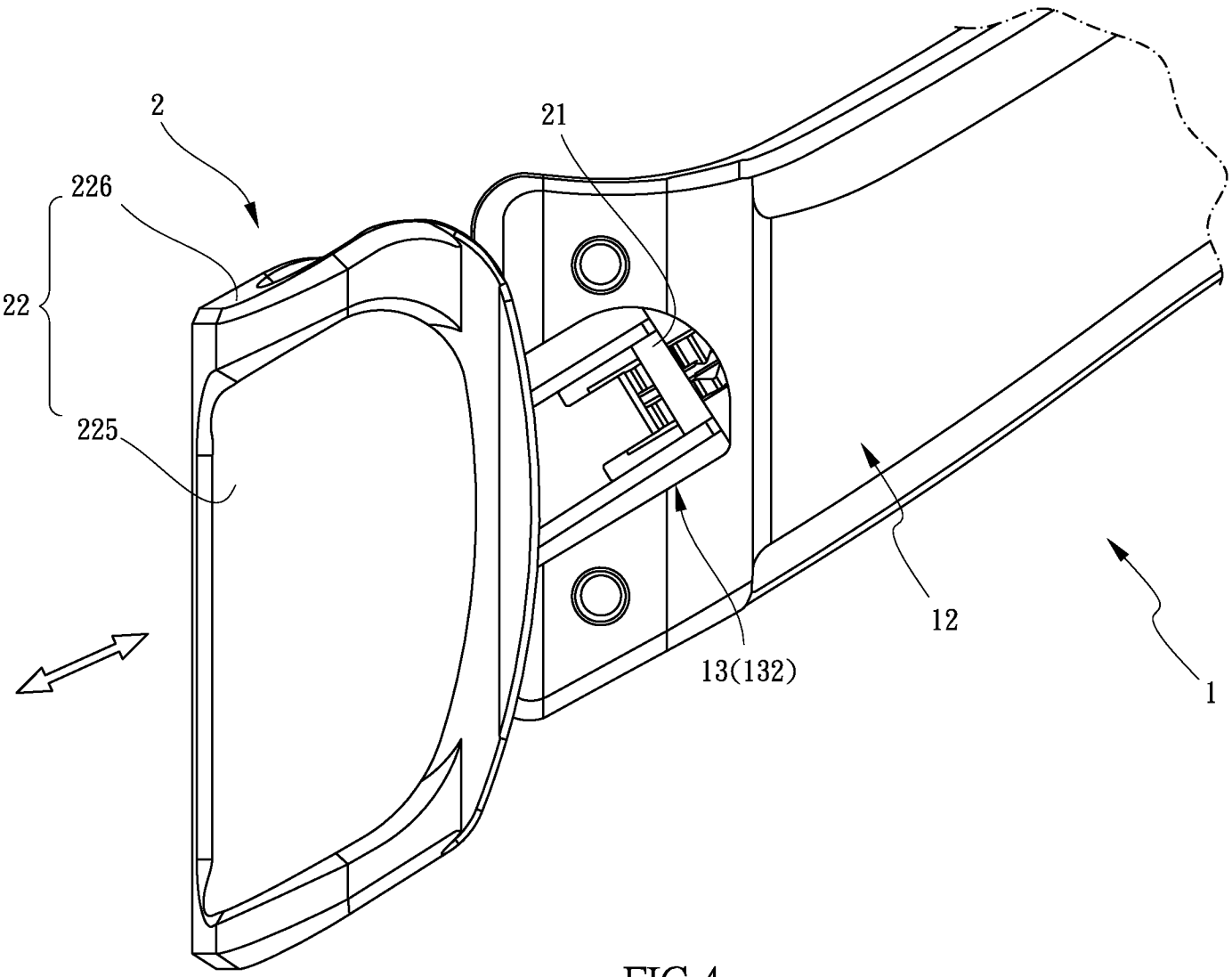
FIG. 4 shows that the slide of the lighting device of the present invention is adjustably slid.
Figure 4A:
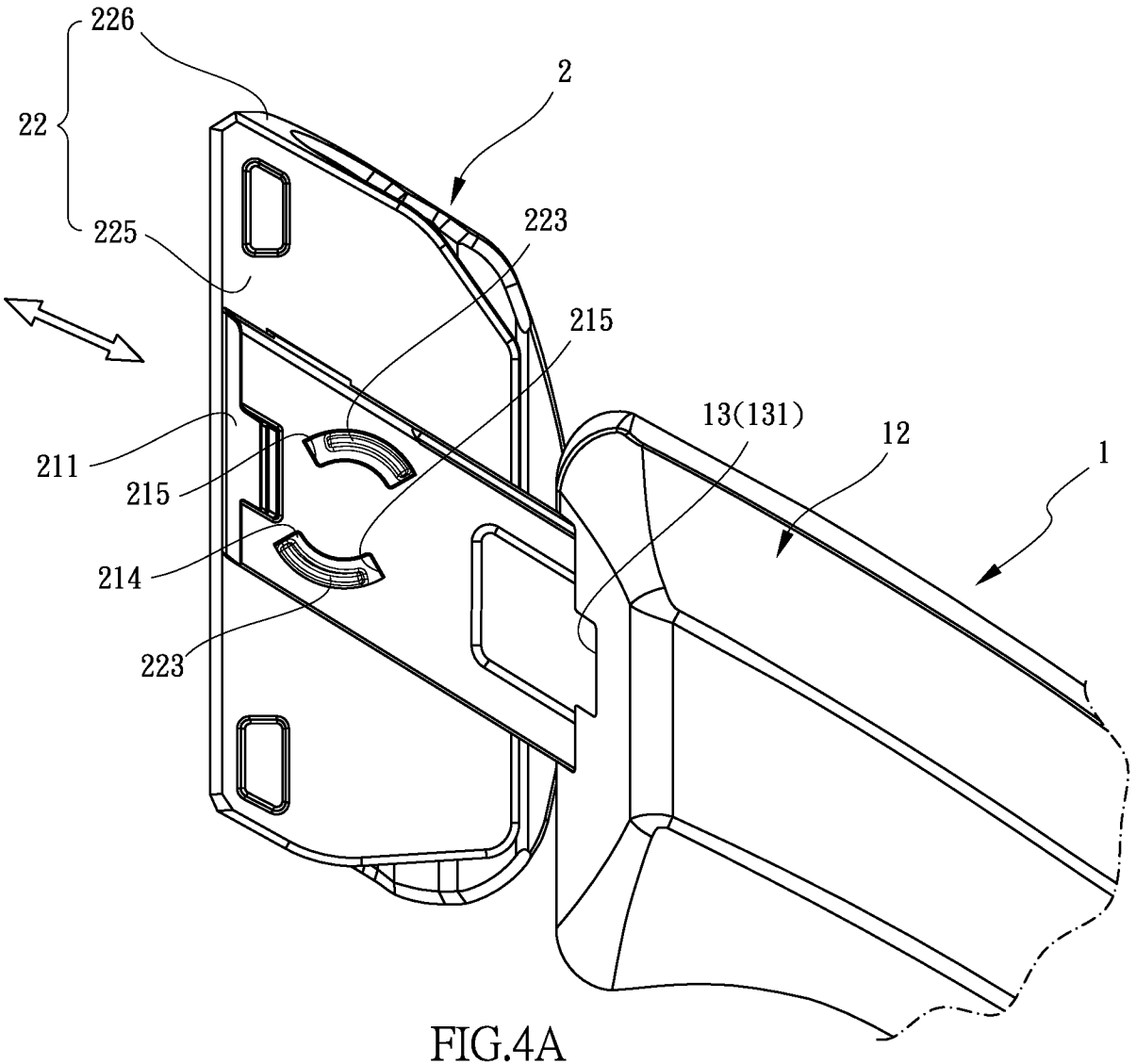
FIG. 4A is another angle of view to show that the slide of the lighting device of the present invention is adjustably slid.
Figure 5:
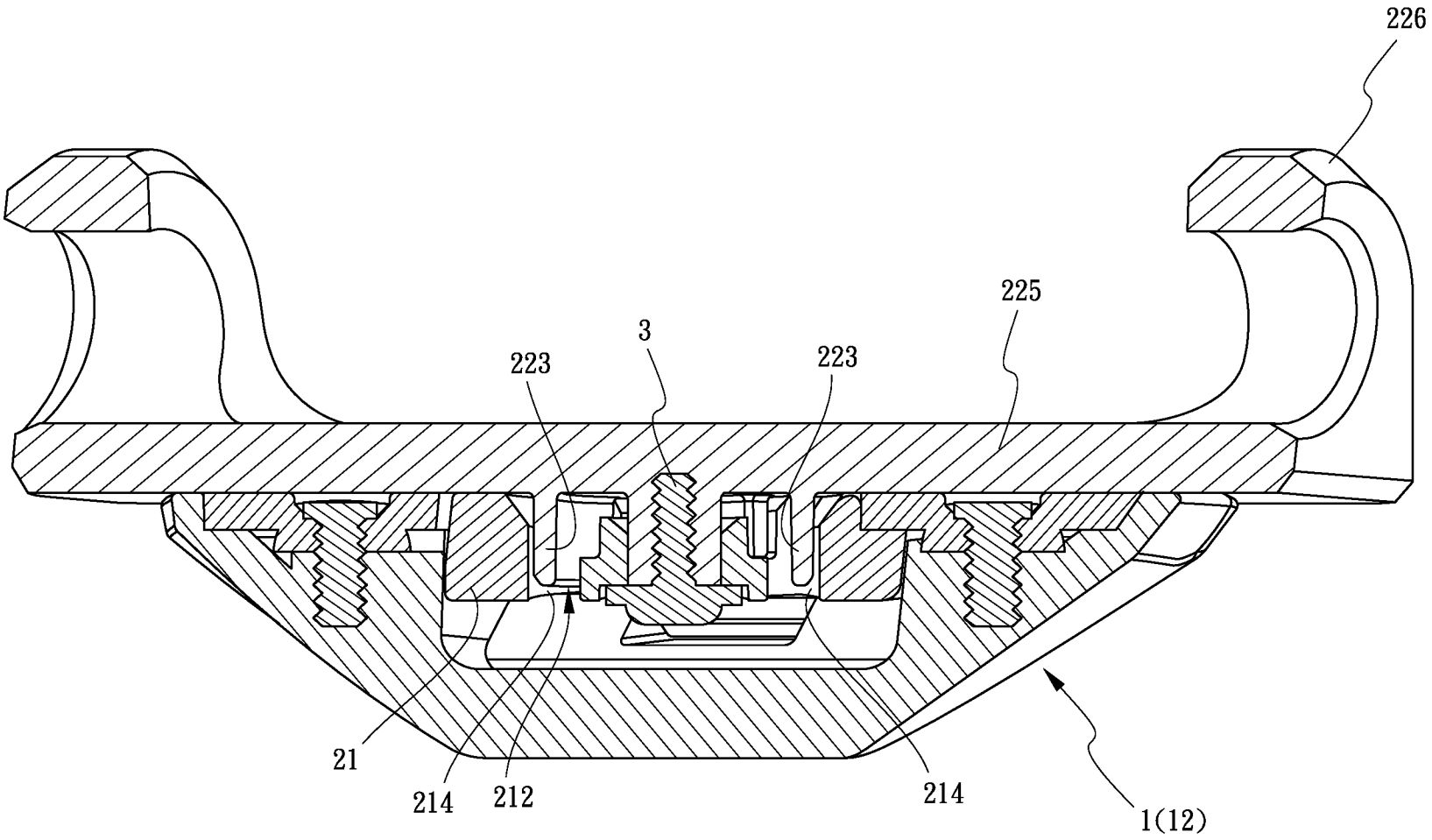
FIG. 5 is a cross sectional view, taken along line V-V in FIG. 1.
Figure 6:
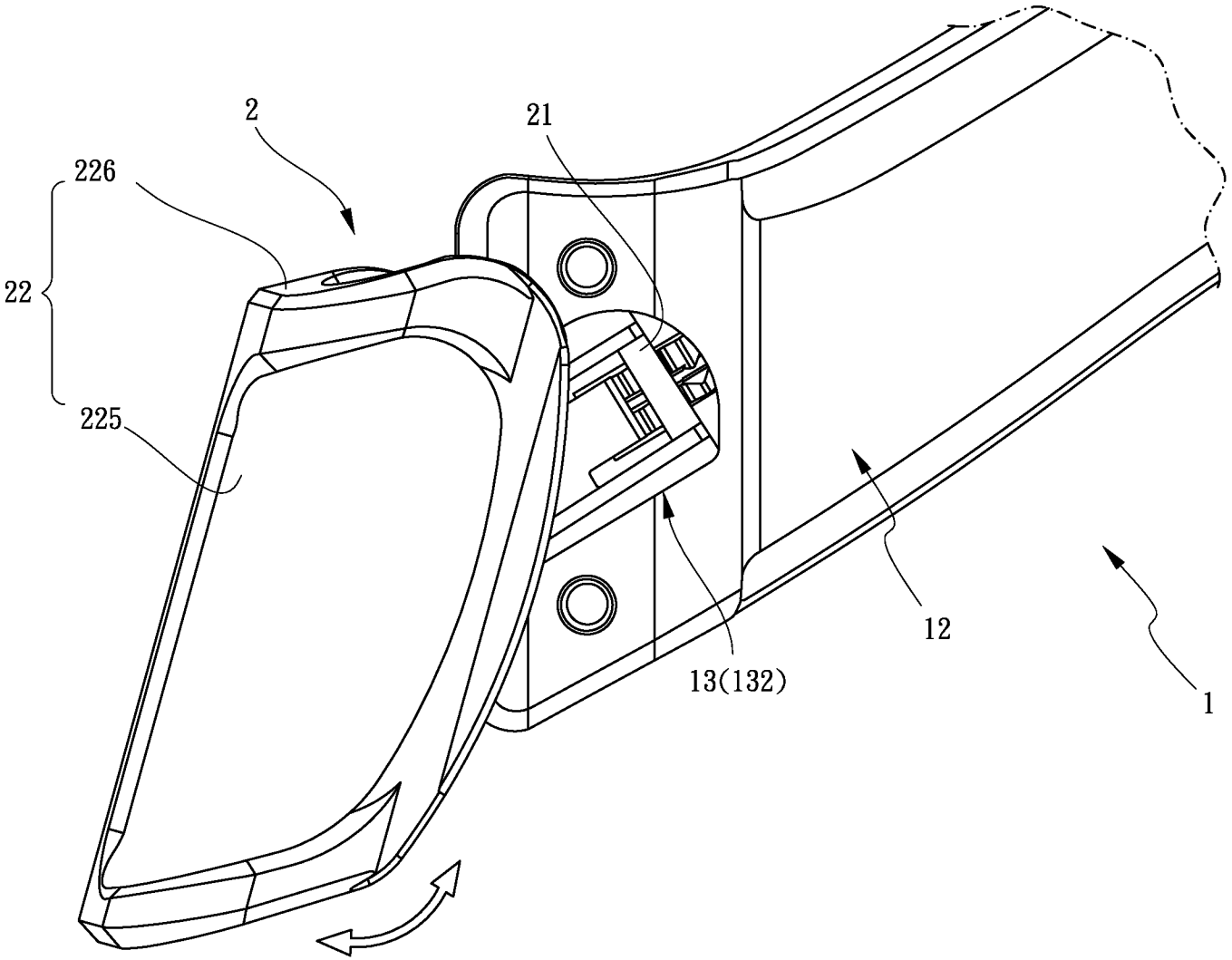
FIG. 6 shows that the clip is pivoted an angle.
Figure 6A:
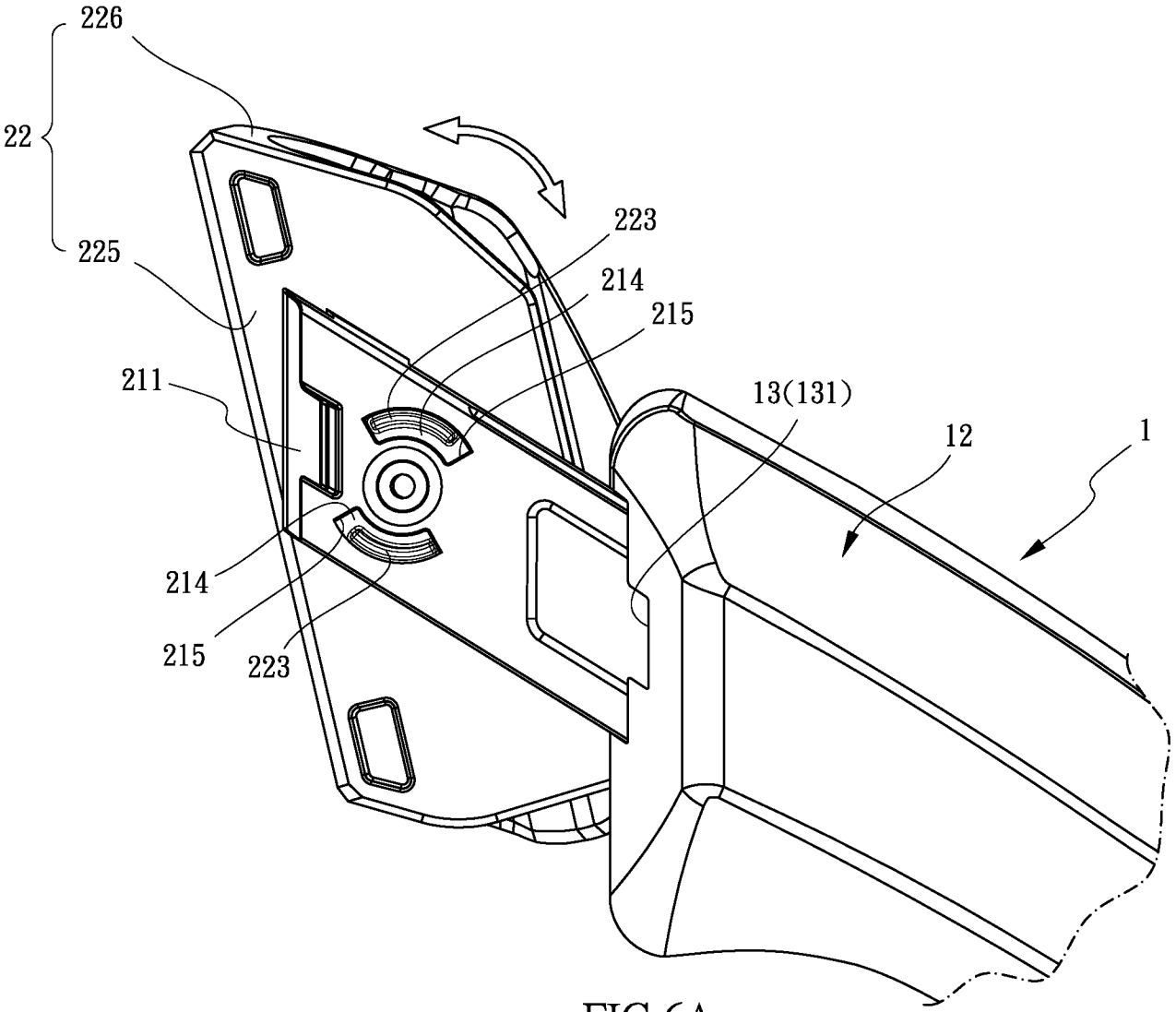
FIG. 6A is another angle of view corresponding to the disclosure in FIG. 6.

As shown in FIGS. 2A, 4, 4A, 6 and 6A, a hole 212 is formed in one side of each slide 21 and a tubular member 213 is located in the hole 212. Two recesses 214 are formed between the tubular member 213 and the inner periphery of the hole 212 as shown in FIG. 2B. The recesses 214 are located corresponding to the first opening 132. Each recess 214 includes two end faces 215. Each clip 22 includes multiple ribs 223 which are slidably located into the recesses 214 corresponding thereto. A bolt 3 extends through the tubular member 213 and connected to the clip 22 as shown in FIG. 5. The clip 22 is then pivotable relative to the slide 21, and the ribs 223 contact the end faces 215 to restrict the pivotable movement of the clip 22. By pivoting the clips 22, the lighting unit 1 can be attached to a visor 101 of different shape and size.

Figure 7A:
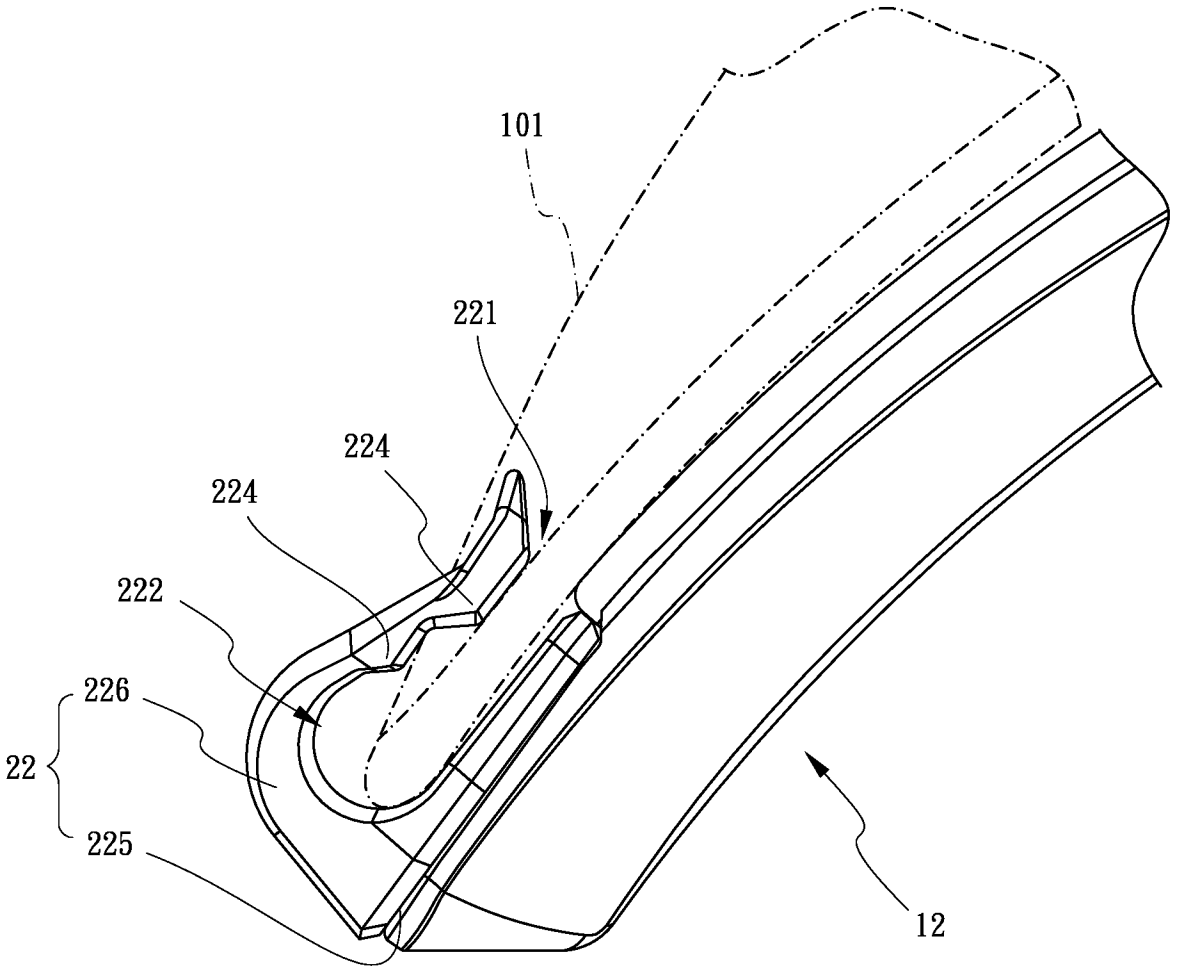
FIG. 7A is an enlarged view to disclose that the teeth of the clip secure the clip to the hat visor.

As shown in FIGS. 2, 7 and 7A, in order to secure the clips 22 to the visor 101, at least one tooth 224 extends from the inner bottom of the slot 221 and is located corresponding to the openings 222. The at least one tooth 224 contacts the visor 101 to restrict a movement of the visor 101. Specifically, each clip 22 includes a board 225 and a resilient portion 226 wherein the two ends of the resilient portion 226 are flexible and formed to the board 225 so that the slot 221 is formed between the board 225 and the resilient portion 226. Users can slightly lift the resilient portion 226 to widen the slot 221 to insert the visor 101 into the slot 221, when the resilient portion 226 is released, the at least one tooth 224 contacts the visor 101 to position the clip 22 to the visor 101.

Figure 8:
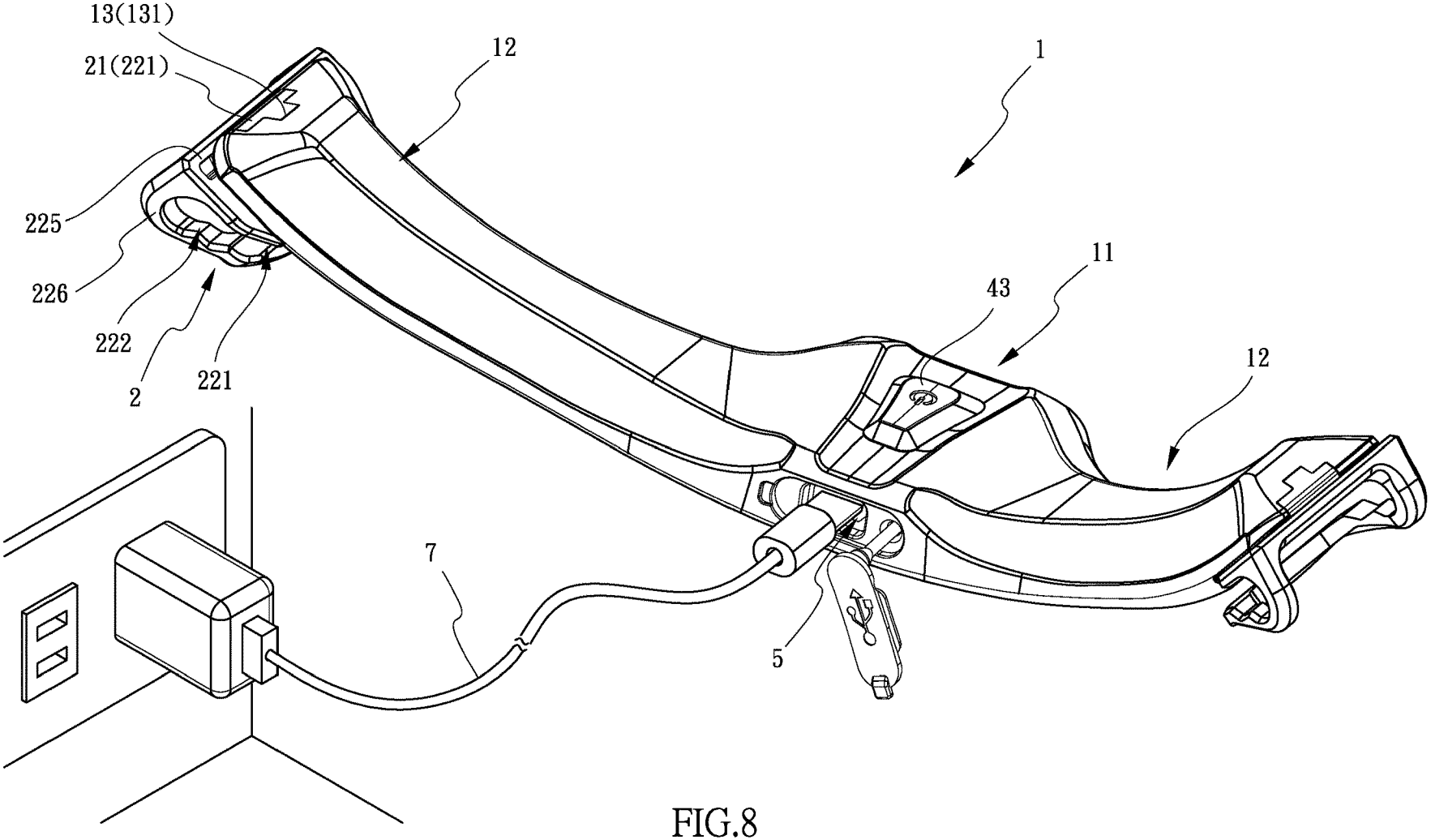
FIG. 8 shows that the lighting device of the present invention is charged from the city electric power source.

The lighting portion 11 includes a room 111, and a lighting emitting unit 4 is located in the room 111 and generates light beams which pass through the lighting portion 11. The lighting unit 1 includes a charging port 5 and a switch 6 both electrically connected to the lighting emitting unit 4. The lighting unit 1 can be charged by a plug with a cable 7 as shown in FIG. 8. The cable 7 is removably connected between the charging portion 5 and a power source to provide electric power to the lighting emitting unit 4. The lighting emitting unit 4 includes a circuit board 42 and a button 43. The charging port 5 and the switch 6 both electrically connected to the circuit board 42. The button 43 is located on a surface of the lighting unit 1 and partially inserted into a notch 431. When the user pushes the button 43, the switch 6 operated to activate or de-activate the lighting emitting unit 4.

While we have shown and described the embodiment in accordance with the present invention, it should be clear to those skilled in the art that further embodiments may be made without departing from the scope of the present invention.

What is claimed is:

1. A lighting device comprising:

a lighting unit including a lighting portion, two arms respectively formed on two ends of the lighting portion, each arm including at least one reception portion, and multiple attachments each having a slide and a clip, the slide of each attachment slidably engaged with the at least one reception portion of each arm, the clip pivotably connected to the slide, each clip having a slot which includes an opening formed in each of two ends thereof, the slot of each clip is adapted to clip a visor of a hat, the clip being adjustable by sliding the slide relative to the at least one reception portion, the clip being pivotable to adjust a direction of the slot.

2. The lighting device as claimed in claim 1, wherein each reception portion includes a groove, each slide includes a rail protruding therefrom, the rail is slidably engaged with the groove corresponding thereto.

3. The lighting device as claimed in claim 1, wherein each reception portion includes a first opening and a second opening, the first and second openings communicate with the reception portion, the first opening is located at a top face and/or a bottom face of the reception portion corresponding thereto, the second opening is located at a distal end of the arm corresponding thereto and located corresponding to the first opening.

4. The lighting device as claimed in claim 1, wherein each slide includes multiple recesses which are located corresponding to the first opening, each recess includes two end faces, each clip includes multiple ribs which are slidably located in to the recesses corresponding thereto, the clip is pivotable relative to the slide, and the ribs contact the end faces to restrict a pivotable movement of the clip.

5. The lighting device as claimed in claim 1 further comprising at least one tooth extending from an inner bottom of the slot and located corresponding to the openings, the at least one tooth adapted to contact the visor to restrict a movement of the visor.

6. The lighting device as claimed in claim 1, wherein the lighting portion includes a room, a lighting emitting unit is located in the room and generates light beams which pass through the lighting portion, the lighting unit includes a charging port and a switch both electrically connected to the lighting emitting unit.

7. The lighting device as claimed in claim 1, wherein the lighting emitting unit includes a circuit board and a button, the charging port and the switch both electrically connected to the circuit board, the button is located on a surface of the lighting unit and partially inserted into a notch, the switch is controlled by pushing the button.

* * * * *